US006264120B1

(12) United States Patent
Wintering et al.

(10) Patent No.: US 6,264,120 B1
(45) Date of Patent: Jul. 24, 2001

(54) PORTABLE AUTOMATED MISTING DEVICE

(75) Inventors: Gary Wintering; Leonard Montenegro, both of Tempe, AZ (US)

(73) Assignee: Arizona Mist, Inc., Tempe, AZ (US)

( * ) Notice: Subject to any disclaimer, the term of this patent is extended or adjusted under 35 U.S.C. 154(b) by 0 days.

(21) Appl. No.: 09/444,910

(22) Filed: Nov. 22, 1999

Related U.S. Application Data

(63) Continuation-in-part of application No. 08/947,228, filed on Oct. 8, 1997, now Pat. No. 6,095,434.

(51) Int. Cl.[7] ..... B05B 9/043

(52) U.S. Cl. ..... 239/333; 239/152; 239/321; 239/331; 239/373; 222/175; 222/386; 222/385; 222/383.3

(58) Field of Search ..... 239/152, 153, 239/154, 320, 321, 329, 331, 333, 349, 340, 350, 352, 354, 342, 373; 222/336, 340, 372, 376, 380, 383.1, 385, 386, 383.3, 379, 175; 169/33

(56) References Cited

U.S. PATENT DOCUMENTS

| | | | | |
|---|---|---|---|---|
| 1,730,684 | * | 10/1929 | Phillips | 239/331 X |
| 1,900,668 | * | 3/1933 | Roselund | 222/385 X |
| 2,048,142 | * | 7/1936 | Santurello | 222/385 X |
| 2,096,042 | * | 10/1937 | Irwin | 239/321 |
| 2,626,185 | * | 1/1953 | Roselund | 239/333 X |
| 2,741,511 | * | 4/1956 | Rollins | 239/331 X |
| 2,789,396 | * | 4/1957 | Jernander et al. | 239/154 X |
| 2,880,939 | * | 4/1959 | Esmay | 239/331 |
| 3,799,448 | * | 3/1974 | Nozawa et al. | 239/321 |
| 4,196,828 | * | 4/1980 | Basile et al. | 222/385 X |
| 4,324,362 | * | 4/1982 | Stansbury, Jr. | 239/331 X |
| 5,031,839 | * | 7/1991 | Waldrum | 239/321 X |
| 5,620,140 | * | 4/1997 | Utter | 239/373 X |
| 5,676,314 | * | 10/1997 | Brass et al. | 239/373 |
| 5,816,447 | * | 10/1998 | Shanklin et al. | 222/385 X |
| 6,095,434 | * | 8/2000 | Montenegro | 239/333 |

* cited by examiner

*Primary Examiner*—David A. Scherbel
*Assistant Examiner*—Steven J. Ganey
(74) *Attorney, Agent, or Firm*—Jordan M. Meschkow; Lowell W. Gresham; Meschkow & Gresham, P.L.C.

(57) ABSTRACT

A portable automatic misting device (20) uses a misting device assembly (38) to automatically disperses a mist (36). The misting assembly (38) includes a hollow cylinder (40) that forms a liquid reservoir (50) that is in fluid communication with a one-way valve (76,102) that permits liquid flow into the reservoir (50). The reservoir (50) has fluid communication with a misting nozzle (34) through a hollow plunger rod (28). A plunger (42), a spring (48) and a portion of the hollow plunger rod (28) are located inside the hollow cylinder (40). The spring (48) is biased to move the plunger (42) and the hollow plunger rod (28) to automatically shrink the liquid reservoir (50). In another embodiment, the plunger rod (28) is solid and the reservoir (50) has fluid communication with the misting nozzle (34) through a second one-way valve (106) that permits liquid flow out of the reservoir (50).

14 Claims, 6 Drawing Sheets

PORTABLE AUTOMATED MISTING DEVICE

RELATED INVENTION

The present invention is a continuation in part (CIP) of "Portable Automatic Misting Device," U.S. patent application Ser. No. 08/947,228, filed Oct. 8, 1997, now U.S. Pat. No. 6,095,434 which is incorporated by reference herein.

TECHNICAL FIELD OF THE INVENTION

The present invention relates generally to the field of atomization of liquids. More specifically, the present invention pertains to a portable device for automatic mist generation.

BACKGROUND OF THE INVENTION

The use of misting devices to produce a cooling effect in a relatively high temperature environment is well known. The cooling effect is produced by an evaporation and absorption of an atomized or vaporized liquid (usually water) by a surrounding high temperature gas (usually air). This evaporation and absorption process reduces the air temperature in an area proximate to the mist. Atomizing or misting nozzles connected to a pressurized water supply are commonly used to produce this cooling mist or vapor.

A known application of this principal attaches multiple misting nozzles to a length of hollow pipe. The pipe is closed at one end and is attached to a pressurized water supply at another end. The pipe is attached to a fixed surface or support such as a post or several ceiling joists. This provides a cooling mist for a local area covered by the fixed misting system.

Other applications use a portable or personal misting device that can be easily carried by an individual wherever they go and activated whenever the individual chooses. One such device incorporates an air pumping mechanism with a portable water bottle and a valve actuated misting nozzle. The air pumping mechanism uses a single cup seal attached to an end of a hollow plunger rod residing inside a hollow cylinder, to force air inside the hollow cylinder into the water bottle. For this device the hollow cylinder is located inside the water bottle and has passages, seals, and one-way valves that allow uni-directional flow from the cylinder into the water bottle. By sliding the plunger rod back and forth inside the hollow cylinder, air is taken in through a one-way valve in the hollow plunger rod, and passed into the hollow cylinder where the cup seal forces the air through another one-way valve and into the water bottle. The valve actuated misting nozzle is attached to the top of the water bottle such that when the water bottle has a sufficient amount of water and compressed air, pressing or holding the valve down causes water to be dispersed through the misting nozzle.

Unfortunately, this portable misting device requires excessive repetitive pumping action to provide sufficient air pressure inside the water bottle before misting can take place. The number of pumps determines the amount of air pressure inside the water bottle which determines the duration and pressure of the mist available to the individual. Longer lasting, higher-pressure mist is desirable for cooling purposes. Unfortunately, to achieve a desirably longer lasting higher-pressure mist, the individual needs to perform more and more pump strokes to increase the air pressure in the water bottle. Furthermore, the valve actuating the misting nozzle must be held depressed during the misting operation, resulting in an inconvenient hands-on type of operation. This misting device uses compressed air to force water through the misting nozzle which requires seals and valves that can provide not only watertight but airtight connections as well.

Accordingly, a need exists for a portable automatic misting device that can pressurize and automatically disperse a liquid through a misting nozzle for a desirable length of time. Such a device should also provide for ease of portability and operation.

SUMMARY OF THE INVENTION

Accordingly, it is an advantage of the present invention to provide a portable automatic misting device.

Another advantage of the present invention is to provide a portable automatic misting device that is actuated by a single manual input pumping stroke.

Another advantage of the present invention is to provide a portable automatic misting device that is easy to carry and easy to operate.

Another advantage of the present invention is to provide a portable automatic misting device that generates a relatively high hydraulic pressure to produce the mist.

Another advantage of the present invention is to provide a portable automatic misting device that does not use airtight seals.

Another advantage of the present invention is to provide a portable automatic misting device that uses a remotely located liquid supply container to provide a relatively high quantity of desirable misting operations.

The above and other advantages of the present invention are carried out in one form by a portable automatic misting device that uses a misting device assembly to automatically disperses a mist. The misting device assembly has a hollow cylinder that forms a liquid reservoir. Located inside the hollow cylinder is a means for regulating the reservoir, including a one-way valve that is configured to permit liquid flow into the reservoir and a resilient member that is coupled to the regulating means and is biased to automatically shrink the reservoir. The assembly also includes a misting nozzle that is in fluid communication with the reservoir.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
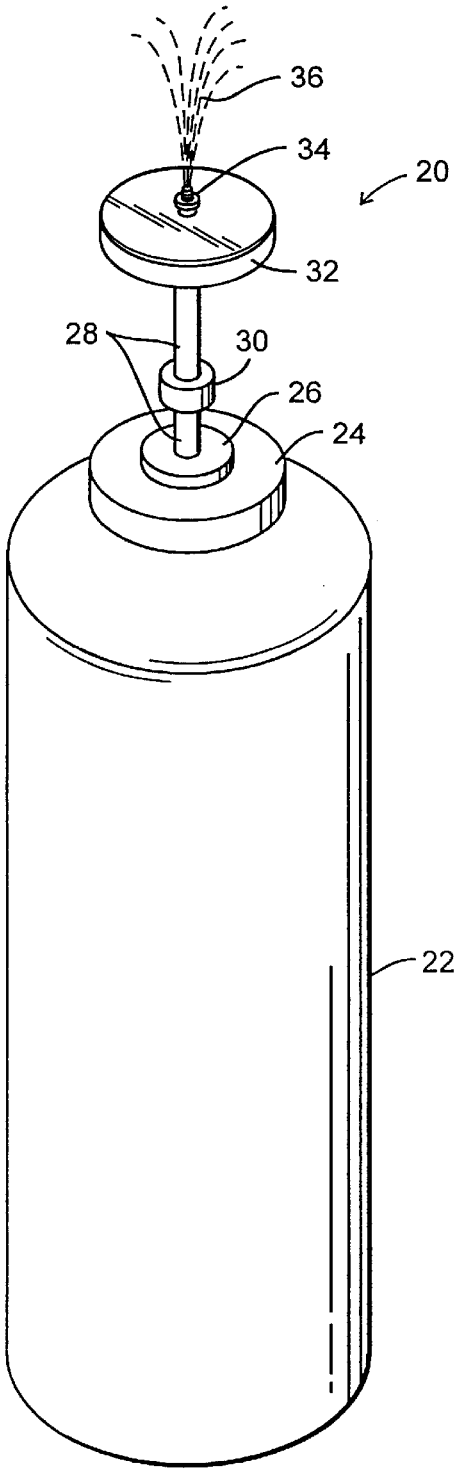
FIG. 1 shows a perspective view of a preferred embodiment of a portable automatic misting device.

FIG. 1 shows a diagram of a preferred embodiment of a portable automatic misting device 20 having a liquid container 22 with a removable coupling 24 surrounding an exit collar 26. A length of hollow plunger rod 28 extends through exit collar 26 and a plunger rod retaining collar 30 and attaches to handle 32. A misting nozzle 34 is attached to handle 32 and is capable of dispersing a mist 36.

Figure 2:
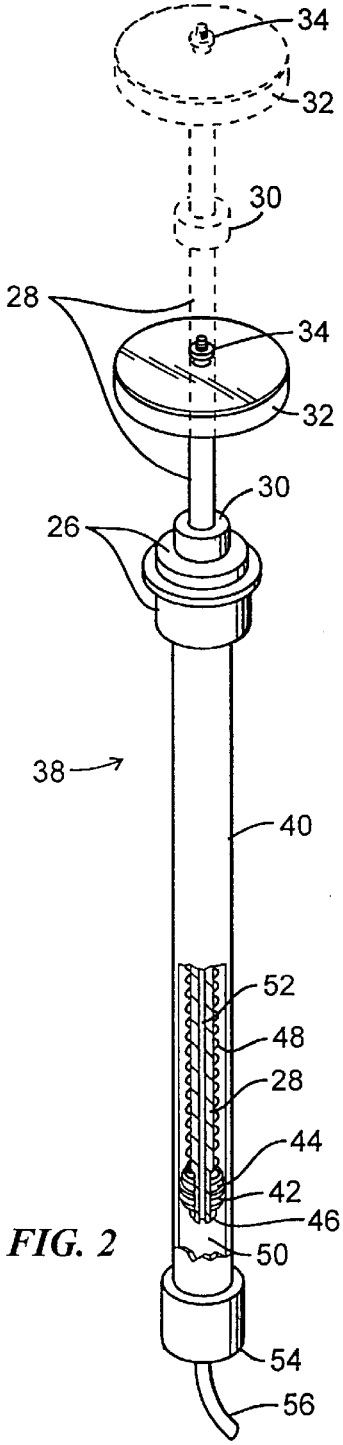
FIG. 2 shows a perspective and cut-away view of an exemplary portable automatic misting device assembly.

FIG. 2 shows a perspective, cut-away view of an exemplary portable automatic misting device assembly 38. For one embodiment, misting device 20 (FIG. 1) is made up of misting device assembly 38 and liquid container 22 and a portion of assembly 38 is located inside liquid container 22 (see FIG. 1). A cut-away portion of assembly 38 in FIG. 2 reveals a hollow cylinder 40 containing a plunger 42 that is coupled to and surrounds a portion of hollow plunger rod 28. Plunger 42 is restrained between a plunger rod collar 44 that is attached to plunger rod 28 and a threaded coupling 46. A compression spring 48 is shown being coaxially mounted with and outside of plunger rod 28 and is restrained by plunger rod collar 44 and exit collar 26. Hollow cylinder 40 is shown forming a liquid reservoir 50 that has fluid communication with misting nozzle 34 through a centrally located flow passage 52 formed by the inside of hollow plunger rod 28. Hollow cylinder 40 also has an inlet collar 54 that is coupled to an inlet hose 56.

FIG. 2 additionally shows in phantom a second position of handle 32 and plunger rod 28. Solid lines in FIG. 2 show spring 48 being extended to a relatively relaxed state such that reservoir 50 has a minimum size. When handle 32 is moved to the phantom position, spring 48 is compressed to a relatively unrelaxed state such that reservoir 50 has a larger than minimum size (not shown).

Figure 3:
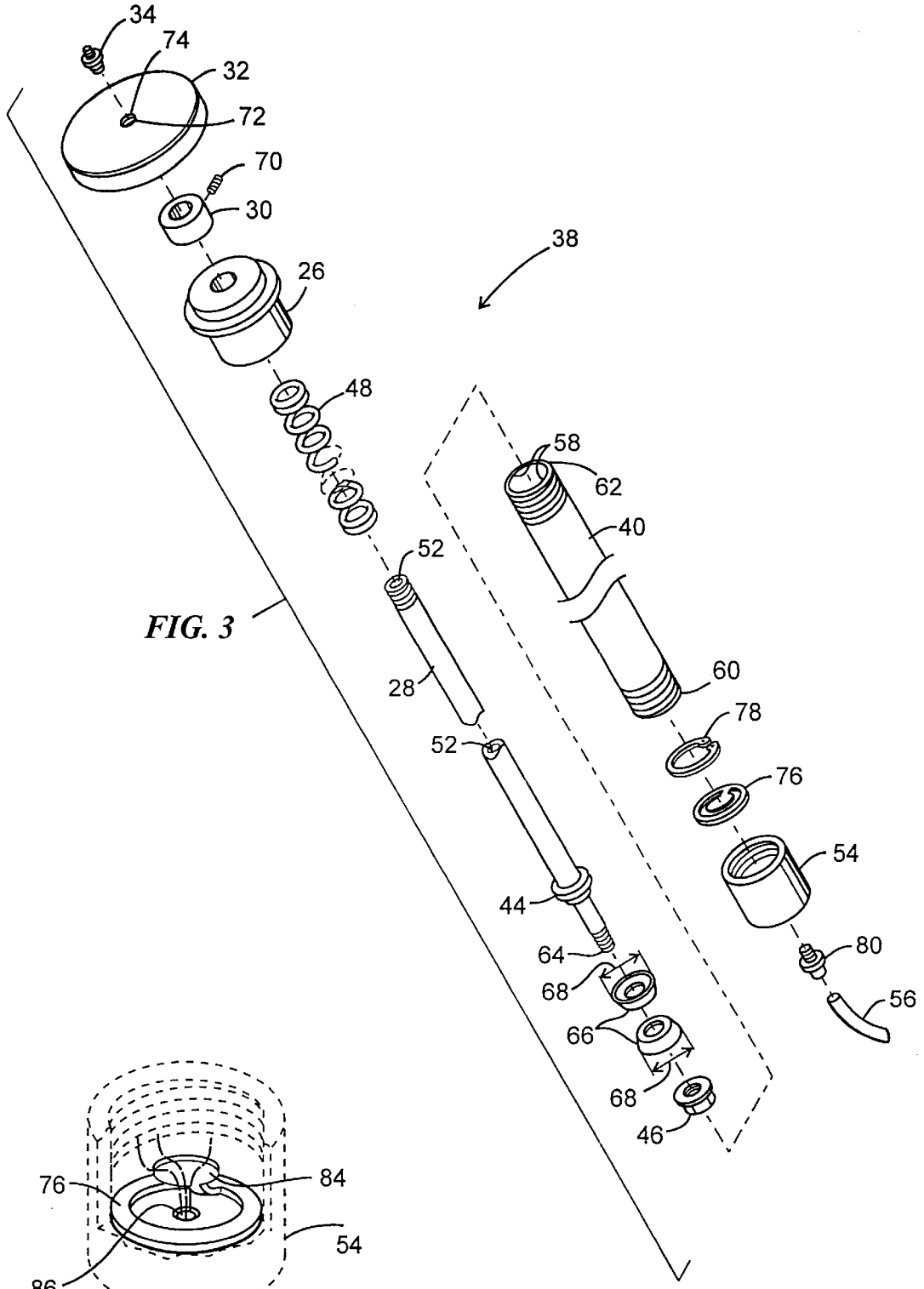
FIG. 3 shows an exploded perspective view of the portable automatic misting device assembly.

FIG. 3 shows an exploded perspective view of portable automatic misting device assembly 38. Hollow cylinder 40 is shown having an inner circumference 58, an inlet end 60, and an exit end 62. Inlet end 60 is located proximate reservoir 50 (FIG. 2) as is a reservoir end 64 of plunger rod 28. Plunger rod collar 44 is located or attached a distance from reservoir end 64 such that when assembled, washers 66 surround a portion of plunger rod 28 and are restrained by collar 44 and threaded coupling 46. Washers 66 are exemplary cup seal shaped washers, each having a longer side or diameter 68. Longer side 68 of washers 66 contact collar 44 or threaded coupling 46 when coupled to form plunger 42 (FIG. 2). Compression spring 48 is a resilient member that is shown coaxially positioned around plunger rod 28. Retainer collar 30 has a set screw 70 that when tightened, couples retainer collar 30 to plunger rod 28 at a desired position to define the minimal size of reservoir 50 (FIG. 2). Handle 32 has an exit orifice 72 and a flow passage 74 connecting flow passage 52 of plunger rod 28 with exit orifice 72 of handle 32. A one-way flapper valve 76 is positioned inside inlet collar 54 by a valve retainer 78. Also shown is an inlet fitting 80 that couples to inlet collar 54 and to inlet hose 56.

Figure 4:
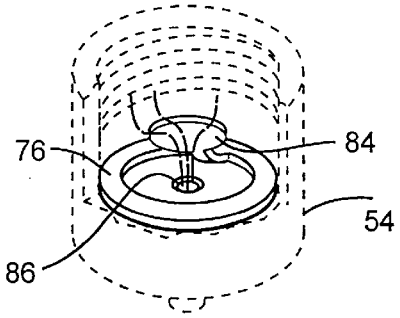
FIG. 4 shows a perspective view of an exemplary one-way flapper valve.

FIG. 4 shows a perspective view of an exemplary one-way flapper valve 76 positioned inside inlet collar 54. Flapper valve 76 is shown having a flap 84 in an open position, so as to permit liquid flow through an inlet orifice 86 into reservoir 50 (FIG. 2). Those skilled in the art realize that a ball valve or any of a variety of one-way valves could be used to regulate liquid flow into reservoir 50 (FIG. 2).

Figure 5:
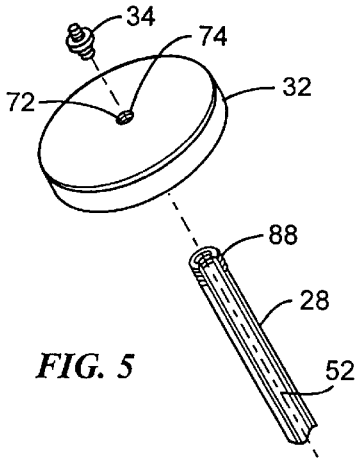
FIG. 5 shows an exploded perspective view of an exemplary misting nozzle, plunger rod and handle used by the portable automatic misting device assembly.

FIG. 5 shows an exploded perspective view of exemplary misting nozzle 34, hollow plunger rod 28, and handle 32. Plunger rod 28 is attached to handle 32 by a threaded coupling 88 and is configured to align plunger rod flow passage 52, with handle flow passage 74 and exit orifice 72.

Figure 6:
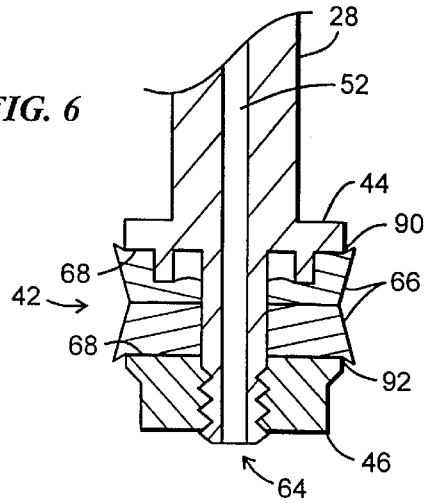
FIG. 6 shows a cross-sectional side view of a plunger and plunger rod coupling used by the portable automatic misting device assembly.

FIG. 6 shows a cross-sectional side view of the mutual coupling between plunger 42 and plunger rod 28. Plunger 42 is coupled proximate plunger rod reservoir end 64 and is formed by coupling washers 66 together. Each washer 66 has a trapezoidal cross-section such that longer side 68 of one washer 66 overlaps a plunger rod collar outer diameter 90 and longer side 68 of second washer 66 overlaps an outer diameter 92 of threaded coupling 46. This overlapping washer material contacts hollow cylinder inner circumference 58 (FIG. 3) and forms a reliable watertight seal where contact is made.

Figure 7:
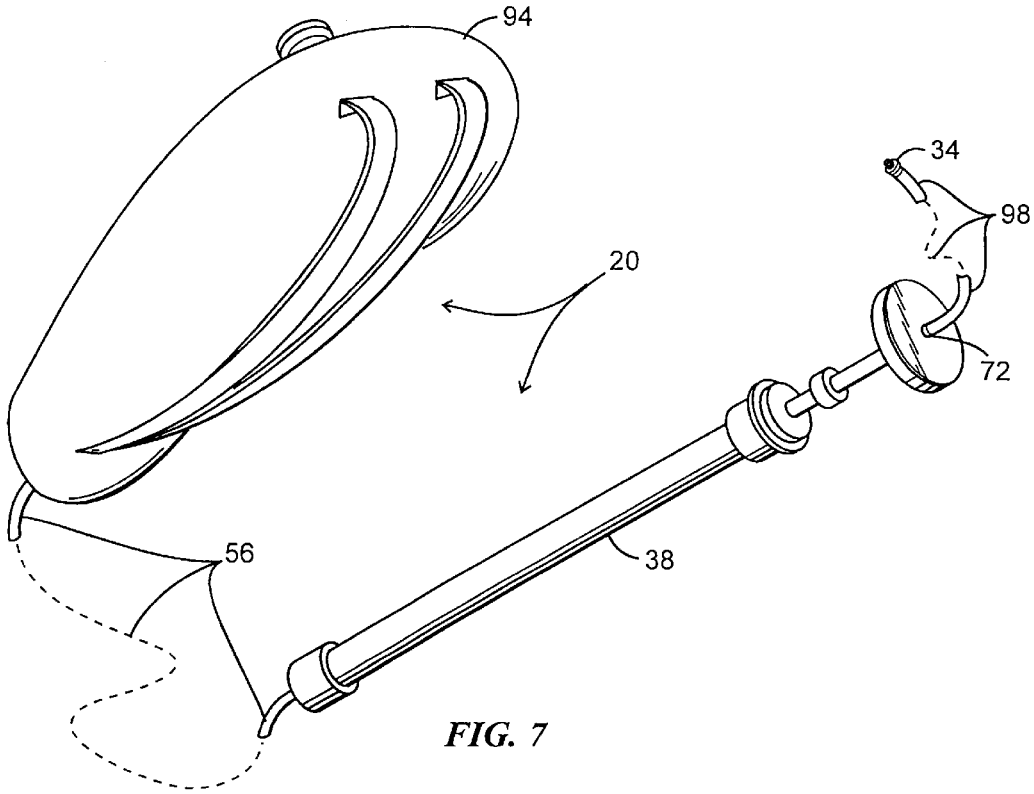
FIG. 7 shows a diagram of a preferred embodiment of a portable automatic misting device having a remotely located liquid supply container.

FIG. 7 shows a diagram of a preferred embodiment of portable automatic misting device 20. In this embodiment, misting device assembly 38 is coupled to a remotely located liquid supply container 94 by inlet hose 56. Separating misting device assembly 38 from liquid supply container 94 provides an ergonomic method for conveniently transporting or carrying relatively large amounts of liquid for providing a relatively high quantity of desirable misting operations. Inlet hose 56 provides a fluid connection between supply container 94 and one-way valve 76 (FIG. 4). In this embodiment, an exit hose 98 couples between exit orifice 72 and misting nozzle 34, allowing misting nozzle 34 to be directed independently from misting device assembly 38.

In operation, misting device 20 is activated or charges by retracting or pulling up on handle 32 to a relative position (phantom in FIG. 2). In this position, spring 48 is compressed and biased to automatically shrink reservoir 50 when it is released. Flapper valve 76 is open and flap 84 is positioned to permit liquid flow through inlet orifice 86 (FIG. 4). Cup seal shaped washers 66 or plunger 42 form a liquid-tight seal with hollow cylinder inner circumference 58 (FIG. 3) and releasing handle 32 causes plunger 42 and plunger rod 28 to move towards inlet end 60. This movement creates hydraulic pressure that causes flapper valve 76 to close, positioning flap 84 over inlet orifice 86, preventing liquid flow through orifice 86 (FIG. 4, valve 76 shown open). Moreover, releasing handle 32 shrinks reservoir 50 (FIG. 2) and forces a displaced quantity of liquid from reservoir 50 into flow passage 52 (FIGS. 2 and 3). This displaced fluid in flow passage 52 is forced by hydraulic pressure through handle flow passage 74, exit orifice 72 and misting nozzle 34 (FIG. 5), producing mist 36 (FIG. 1).

For the above embodiments, spring 48 is a compression or coil spring. However, those skilled in the art will realize that a leaf spring or any of a variety of springs or resilient members could be used to regulate the size of reservoir 50. Moreover, plunger 42 is formed by coupling two cup-seal-shaped washers 66 together to provide a high pressure seal for the bi-directional operation of plunger rod 28. This dual cup seal configuration provides delivery of a higher pressure liquid to misting nozzle 34 than is achieved by conventional single seal configurations.

For one preferred embodiment, liquid container 22 is configured to surround misting device assembly 38 and provide an easily portable and refillable liquid supply for misting operation (FIG. 1). In this embodiment, misting device 20 can be conveniently placed on a flat surface, then handle 32 may be extended (phantom position shown in FIG. 2) and released. A one-stroke operation that provides a hands-off automatic mist dispersion for a desirable length of time (see FIG. 1) results.

In another embodiment, remotely located liquid supply container 94 (FIG. 7) provides fluid to assembly 38 through inlet hose 56.

Figure 9:
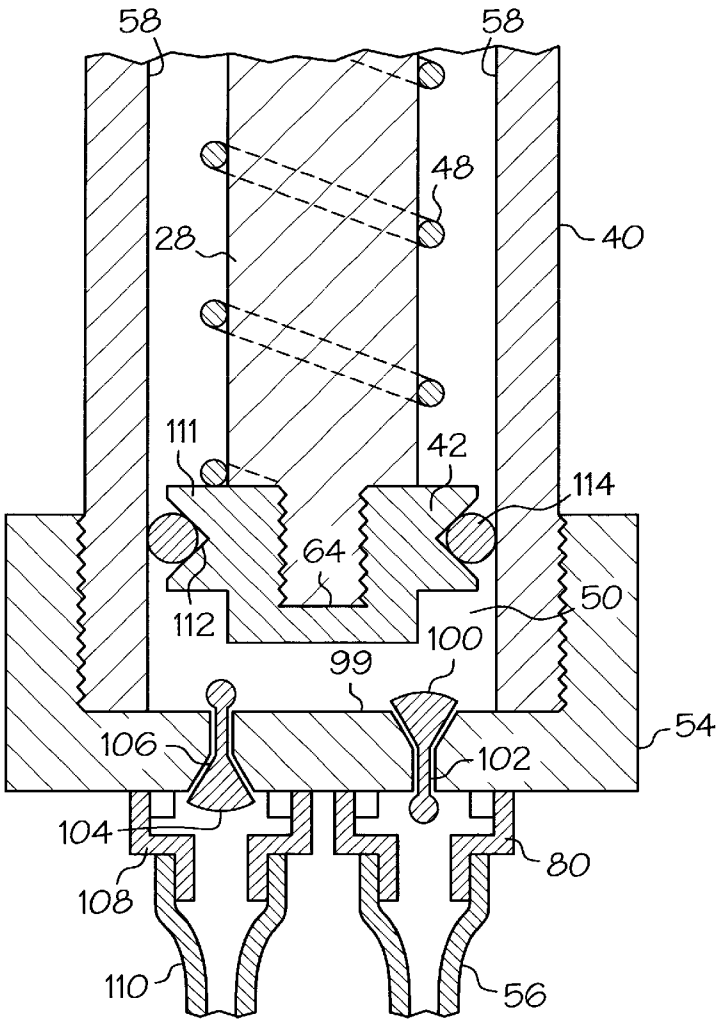
FIG. 9 shows a cross-sectional view of a portion of the portable automatic misting device assembly of FIG. 8.
Figure 8:
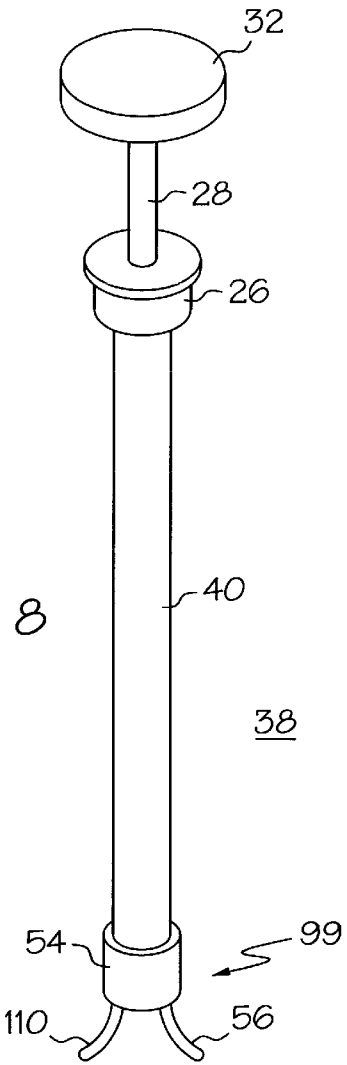
FIG. 8 shows an alternative embodiment of a portable automatic misting device assembly utilizing dual one-way valves.

In an alternative preferred embodiment, portable automatic misting device assembly 38 may be realized as a single-ended assembly using dual one-way valves, as shown in FIGS. 8 and 9.

In this embodiment, hollow cylinder 40 is "single-ended," i.e., the fluid enters and exits the same end of cylinder 40, a reservoir end 99.

During the pumping stroke, i.e., when handle 32 is pulled, plunger rod 28' draws plunger 42 upward, increasing the size of reservoir 50. This in turn unseats conical inlet plug 100 in inlet one-way plug valve 102 and substantially simultaneously seats conical outlet plug 104 in outlet one-way plug valve 106. This allows fluid to be drawn through inlet hose 56, through inlet fitting 80, through inlet one-way plug valve 102, and into reservoir 50. This handle-pulling action compresses compression spring 48.

When handle 32 is released, compression spring 48 pushes against plunger 42 to decrease the size of reservoir 50. This in turn seats conical inlet plug 100 in inlet one-way plug valve 102 and substantially simultaneously unseats conical outlet plug 104 in outlet one-way plug valve 106. This allows fluid to be passed from reservoir 50, through outlet one-way plug valve 106, through outlet fitting 108, and through outlet hose 110.

Those skilled in the art will appreciate that while inlet and outlet valves 102 and 106 are one-way plug valves, other one-way valves may be used, e.g., flapper valves, without departing from the spirit of the present invention.

As in the previously discussed embodiments, handle 32, plunger rod 28', and plunger 42 are affixed together to regulate the size of reservoir 50. Unlike the previously discussed embodiments, however, the fluid does not pass through plunger 42 and plunger rod 28' in the single-ended, dual valve embodiment. Therefore, plunger rod 28' and plunger 42 may be solid, as depicted in FIG. 9.

In the hereinbefore discussion, plunger 42 included plunger rod collar 44, first and second cup seal washers 66, and threaded coupling 46 (see FIGS. 3 and 6). The outer circumferences of washers 66 were configured to form a substantially watertight seal with inner circumference 58 of hollow cylinder 40.

FIG. 9 depicts an alternative embodiment of plunger 42. In this alternative embodiment, plunger 42 has threaded body 111 with a circumferential groove 112 in which resides an O-ring 114. Threaded body 111 is affixed to reservoir end 64 of plunger rod 28' by being threaded thereon. O-ring 114 contacts inner circumference 58 of hollow cylinder 40 to form the requisite substantially watertight seal. Those skilled in the art will appreciate that the embodiments described herein for plunger 42 are effectively interchangeable.

Figure 10:
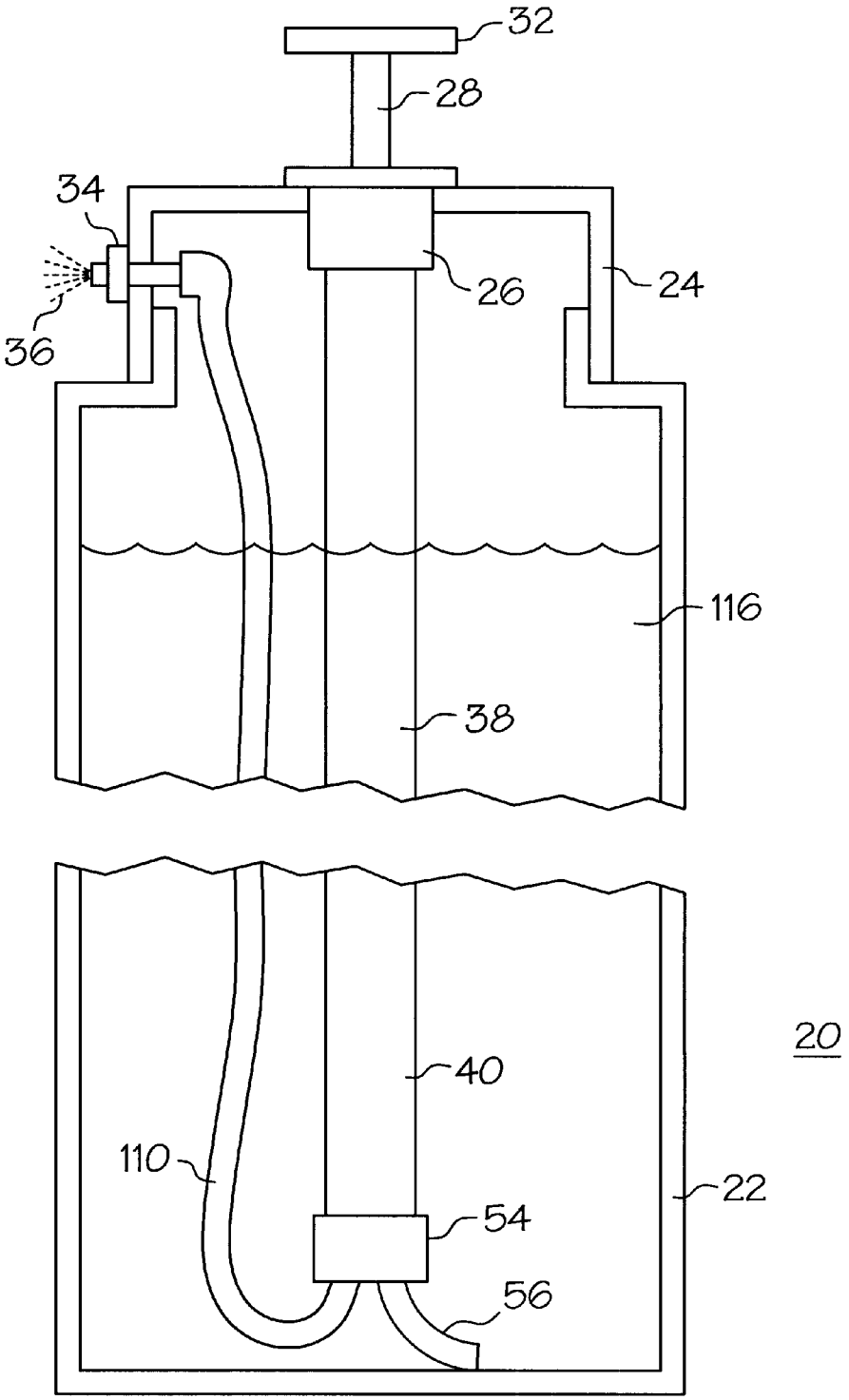
FIG. 10 shows a cutaway view of a portable automatic misting device utilizing the assembly of FIG. 8 within a liquid container.

FIG. 10 shows portable automatic misting device 20 utilizing the single-ended, dual valved embodiment of misting device assembly 38 with enclosing liquid container 22. In this embodiment, outlet hose 110 is connected to misting nozzle 34, which is attached to and passes through removable coupling 24 (i.e., a cap of container 22). Container 22 is filled with a fluid 116, which passes into inlet hose 56, through misting device assembly 38, through outlet hose 110, and through misting nozzle 34 to produce mist 36.

Figure 11:
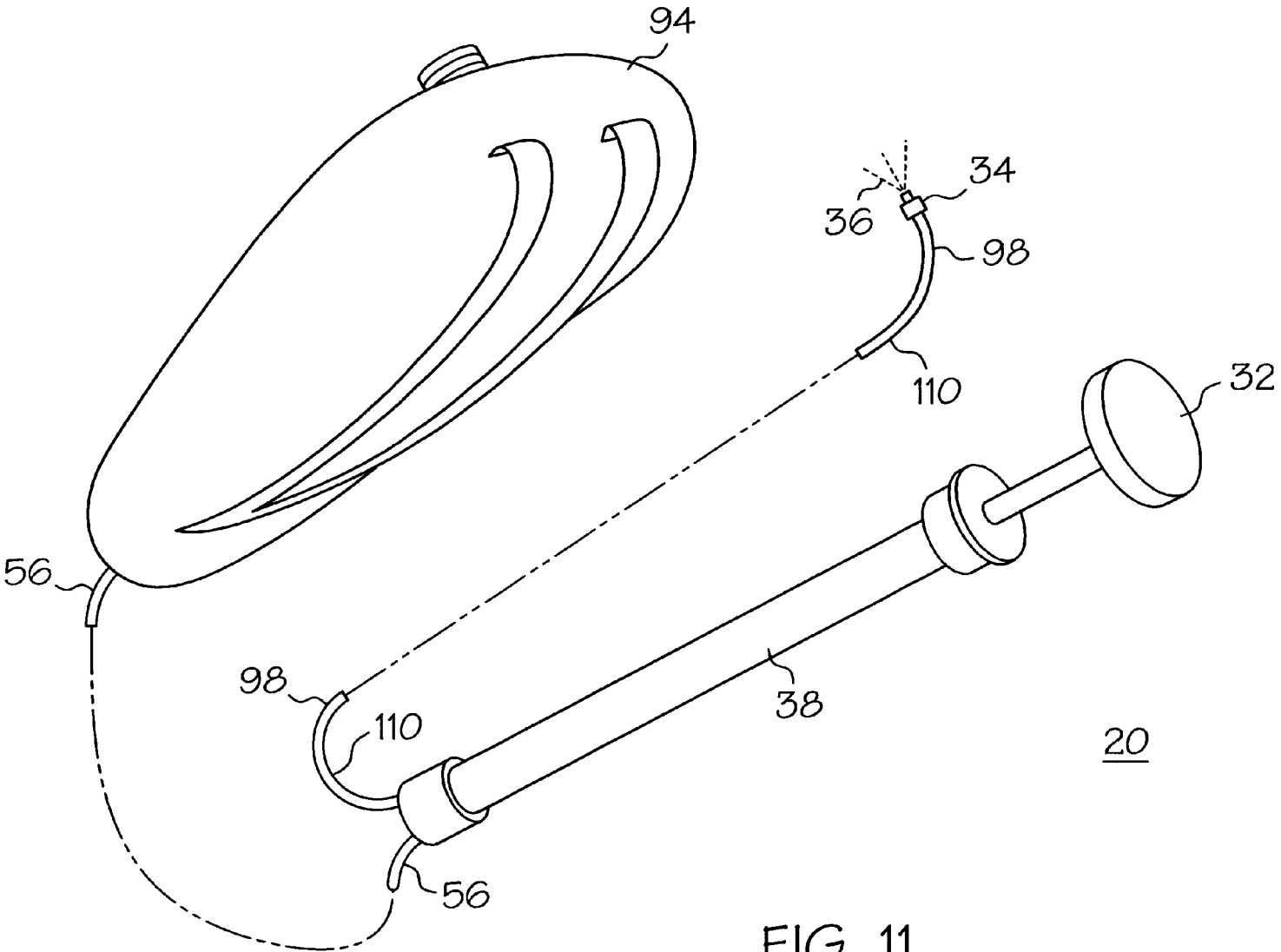
FIG. 11 shows a portable automatic misting device utilizing the assembly of FIG. 8 with a remotely located liquid supply container.

FIG. 11 shows portable automatic misting device 20 utilizing the single-ended, dual valved embodiment of misting device assembly 38 with remotely located liquid supply container 94. In this embodiment, outlet hose 110 is coincident with exit hose 98 (also see FIG. 7). Fluid (not shown) passes from remotely located liquid supply container 94, through inlet hose 56, through misting device assembly 38, through outlet/exit hose 110/98, and through misting nozzle 34 to produce mist 36. This embodiment has several distinct advantages in that both container 94 and misting nozzle 34 are separated from device assembly 38, hence isolated from any motion imparted to device assembly 38 during the pumping stroke, i.e., the action of drawing handle 32.

In summary, portable automatic misting assembly 38 (FIG. 2) is easy to carry and operates by using a single manual input pumping stroke to generate a relatively high hydraulic pressure which is used for automatic mist dispersion of a liquid. In one embodiment, misting assembly 38 uses remotely located liquid supply container 94 (see FIG. 7) to carry a relatively large amount of liquid to provide a relatively high quantity of desirable misting operations.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A portable misting device that automatically disperses a mist, said device comprising:

a hollow cylinder forming a liquid reservoir therein;

a plunger configured to form a substantially liquid-tight seal with an inner circumference of said cylinder;

a plunger rod having a first end proximate said reservoir and a second end opposing said first end, said first end being affixed to said plunger;

a handle affixed to said second end of said plunger rod;

a first one-way valve coupled to said cylinder and configured to permit liquid flow into said reservoir;

a second one-way valve coupled to said cylinder and configured to permit liquid flow out of said reservoir;

a resilient member coupled to said plunger and biased to automatically shrink said reservoir; and a misting nozzle fluidly coupled to said cylinder through said second one-way valve and configured to produce said mist.

2. A portable misting device as claimed in claim 1 additionally comprising a liquid container fluidly coupled to said reservoir through said first one-way valve.

3. A portable misting device as claimed in claim 1 wherein said resilient member is a spring coaxial with said plunger rod.

4. A portable misting device as claimed in claim 1 wherein said plunger comprises:

a body affixed to said first end of said plunger rod and having a circumferential groove; and an O-ring coupled to said body within said circumferential groove and configured to form said substantially liquid-tight seal.

5. A portable misting device as claimed in claim 4 wherein said plunger body is threaded upon said first end of said plunger rod.

6. A portable misting device as claimed in claim 1 wherein said plunger and said plunger rod together serve to regulate a size of said reservoir.

7. A portable misting device as claimed in claim 1 wherein said resilient member is a compression spring coaxially positioned around said plunger rod and wherein:

said spring has a first end restrained at said plunger;

said spring has a second end restrained at an end of said cylinder proximate said handle;

said spring is configured such that said reservoir has a minimal size when said spring is extended; and said spring is configured such that said reservoir has a size larger than said minimal size when said spring is compressed.

8. A portable misting device as claimed in claim 7 wherein said first one-way valve is configured to permit said liquid flow into said reservoir when said spring is being compressed and to inhibit said liquid flow into said reservoir when said compressed spring is being relaxed.

9. A portable misting device as claimed in claim 8 wherein said second one-way valve is configured to inhibit said liquid flow out of said reservoir when said spring is being compressed and to permit said liquid flow out of said reservoir when said compressed spring is being relaxed.

10. A portable misting device as claimed in claim 1 additionally comprising:

an outlet fitting coupled to said second one-way valve; and an outlet hose coupled between said outlet fitting and said misting nozzle.

11. A portable misting device as claimed in claim 1 additionally comprising:

an inlet fitting coupled to said first one-way valve; and an inlet hose coupled to said inlet fitting.

12. A portable misting device as claimed in claim 1 additionally comprising a liquid container coupled to said inlet hose.

13. A portable misting device that automatically disperses a mist, said device comprising:

a hollow cylinder forming a liquid reservoir at a first end, thereof a solid plunger rod having a first end proximate said reservoir and a length that extends through a second end of said cylinder opposing said first end of said cylinder;

a handle coupled to said extended length of said plunger rod;

a plunger coupled to said first end of said plunger rod and configured to form a liquid-tight seal between an inner circumference of said cylinder and said reservoir;

a first one-way valve coupled to said cylinder and configured to permit liquid flow into said reservoir;

a second one-way valve coupled to said cylinder and configured to permit liquid flow out of said reservoir;

a compression spring coaxially positioned around said plunger rod, said spring being restrained on a first end of said spring at said plunger and on a second end at an of said spring saids seconds end of said cylinder said spring being configured such that when said spring is extended to a relatively relaxed state, said reservoir has a minimum size and when said spring is compressed to a relatively unrelaxed state, said reservoir size is a larger size than said minimum size; and a misting nozzle coupled to said second one-way valve so as to be in fluid communication with said reservoir.

14. A portable misting device as claimed in claim 13 additionally comprising:

an inlet fitting coupled to said first one-way valve;

an inlet hose coupled to said inlet fitting;

an outlet fitting coupled to said second one-way valve; and an outlet hose coupled between said outlet fitting and said misting nozzle.

* * * * *